United States Patent [19]

Tanaka et al.

[11] Patent Number: 4,518,952

[45] Date of Patent: May 21, 1985

[54] SENSOR TEST CIRCUIT OF AN ALARM SYSTEM

[75] Inventors: Hiroshi Tanaka; Tetsuo Kimura, both of Tokyo; Seiichi Tanaka, Chiba; Takashi Suzuki, Tokyo, all of Japan

[73] Assignee: Nittan Company, Limited, Tokyo, Japan

[21] Appl. No.: 527,465

[22] Filed: Aug. 29, 1983

[30] Foreign Application Priority Data

Sep. 10, 1982 [JP] Japan ..... 57-156598

[51] Int. Cl.[3] ..... G08B 29/00

[52] U.S. Cl. ..... 340/514; 340/511; 340/515

[58] Field of Search ..... 340/514, 500, 502–506, 340/511, 510, 515, 518, 825.06, 870.21, 870.09, 870.16; 324/158 F

[56] References Cited

U.S. PATENT DOCUMENTS 3,973,257 8/1976 Rowe ..... 340/511

3,991,362 11/1976 Blair et al. ..... 340/514

*Primary Examiner*—Donnie L. Crosland

*Attorney, Agent, or Firm*—Hill, Van Santen, Steadman & Simpson

[57] ABSTRACT

When a receiver supplies both an address signal and a test instruction signal to a given terminal unit, a test voltage generator forming a sensor test circuit of this terminal unit supplies a predetermined test voltage to a corresponding sensor. This sensor generates an analog signal obtained by superimposing the test voltage on the normally detected voltage. The analog signal is A/D-converted, and a resultant digital signal is received by the receiver, thereby allowing a test for operating conditions of any sensor at the site of the receiver. The test voltage generator may generate a plurality of stepwise voltage components to readily check operating characteristics (e.g., overload characteristic) of the sensor.

8 Claims, 3 Drawing Figures

SENSOR TEST CIRCUIT OF AN ALARM SYSTEM

BACKGROUND OF THE INVENTION

The present invention relates to an alarm system for fire, gas leakage or the like wherein sensors are installed in several locations to generate analog output signals respectively corresponding to smoke concentrations, gas concentrations, or temperatures at these locations, the sensors being accessed by addresses from a receiver installed in a remote location so that the accessed sensors supply analog signals to the receiver. More particularly, the present invention relates to a sensor test circuit for testing operation of the sensors from a remote location.

In a conventional alarm system of this type, a smoke test for checking sensors located at the corresponding terminals has been conducted such that smoke is deliberately generated to simulate an emergency at each sensor position and a sensor output is then received at a receiver. Therefore, maintenance personnel at each sensor location must communicate with those at the receiver location. However, it is very difficult to set a smoke concentration at a desired value. Furthermore, time-consuming, cumbersome testing procedures are required, resulting in inconvenience.

SUMMARY OF THE INVENTION

It is an object of the present invention to eliminate the conventional drawback and to provide a sensor test circuit of an alarm system which allows an operating test of any sensor at a receiver.

In order to achieve the above object of the present invention, there is provided a test circuit of an alarm system having a transmission line, a plurality of terminal units connected to one end of said transmission line in a distributed manner, and a receiver connected to the other end of said transmission line. Each of the plurality of terminal units includes a sensor, an amplifier, an A/D converter, an interface, a test voltage generator and a control circuit. The test circuit comprises the test voltage generator which has a series circuit of a first resistor, a first transistor and a second resistor. This series circuit is connected between positive and negative power source terminals. An analog output is formed of a test voltage and a normally detected voltage. This output generated by the sensor is converted into a digital output by the A/D converter. The digital output is supplied to the receiver when the receiver supplies an address signal and a test instruction signal to a corresponding one of the terminal units.

When a test voltage is generated in a plurality of steps, an overload test of the sensor can be performed, thereby providing highly precise testing.

DETAILED DESCRIPTION OF THE PREFERRED EMBODIMENTS

The preferred embodiments of the present invention will be described in detail with reference to the accompanying drawings. To best understand the present invention, the operating principle of a sensor test circuit will be first described before the preferred embodiments are described.

Figure 1:
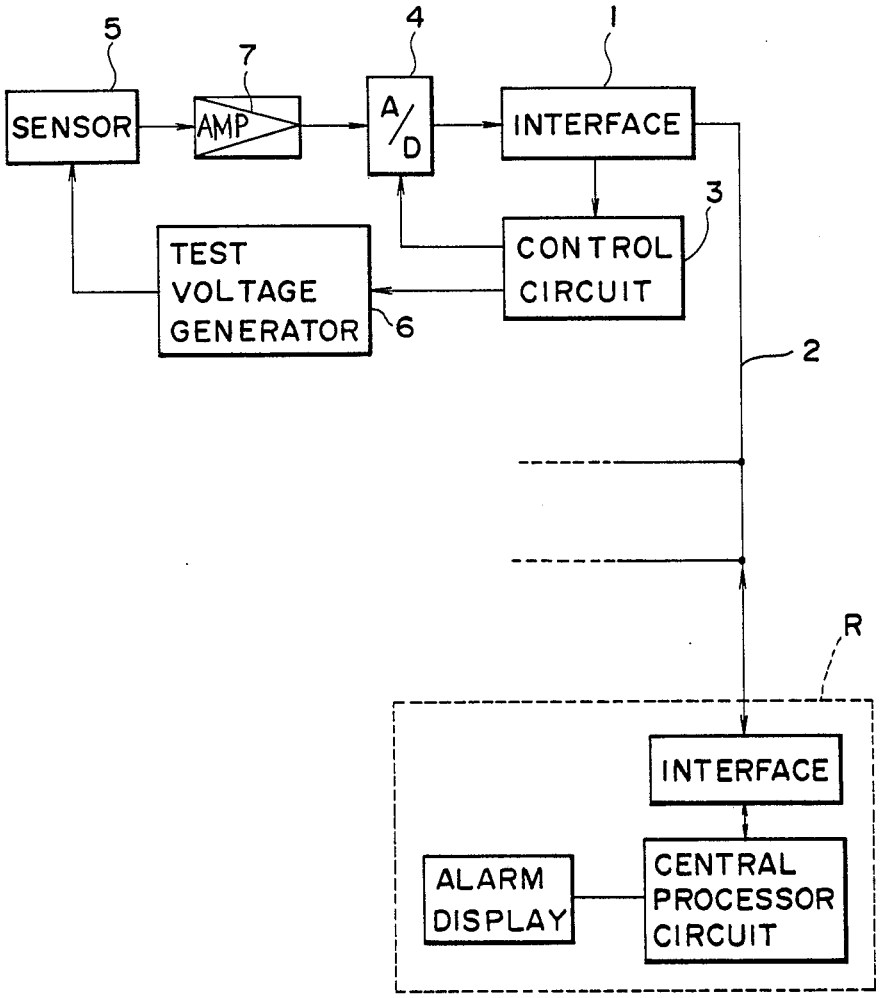
FIG. 1 is a block diagram of an alarm system to show the operating principle of a sensor test circuit.

FIG. 1 is a block diagram of an alarm system to show the operating principle of a sensor test circuit according to a first embodiment of the present invention. The alarm system comprises: a transmission line 2; a plurality of terminal units commonly connected to one end of the transmission line 2 through respective interfaces 1 thereof; and a receiver R connected to the other end of the transmission line 2. Each terminal unit comprises a sensor 5, an amplifier 7, an analog-to-digital converter (to be referred to as an A/D converter hereinafter) 4, a corresponding interface 1, a control circuit 3 and a test voltage generator 6 as the sensor test circuit. The interface 1 supplies a signal from the transmission line 2 to the control circuit 3. The interface 1 receives digital data from the A/D converter 4 and converts the digital data to data having a format suitable for the transmission line 2. The receiver R cyclically accesses the terminal units and receives data from each corresponding interface to continuously monitor the absence/presence of an emergency such as a fire. Furthermore, the receiver R can send an address signal and a test instruction signal to any desired sensor. The control circuit 3 of each terminal unit detects an input address signal.

When a given control circuit 3 receives the corresponding address signal, it drives the A/D converter 4 so that the A/D converter 4 converts the analog output data (after the analog output data is amplified by the amplifier 7) from the sensor 5 to digital data. The digital data is supplied onto the transmission line 2 through the interface 1 and is received by the receiver R.

When a given control circuit 3 of a terminal unit receives both the corresponding address signal and the corresponding test instruction signal, the control circuit 3 drives the test voltage generator 6. In this case, the test voltage generator 6 supplies to the sensor 5 a predetermined test voltage or a stepwise voltage corresponding to the test instruction signal. Therefore, the sensor 5 generates the analog output signal obtained by superimposing the normal detected voltage on the test voltage. This analog output signal is then amplified by the amplifier 7 and is converted by the A/D converter 4. This digital signal is sent onto the transmission line 2 through the interface 1 and is then received by the receiver R. The receiver R analyzes the output data corresponding to the test voltage to detect whether or not the sensor 5 is normally operated. When the test voltage is generated in a stepwise manner, a number of output signals corresponding to the stepped voltage components can be obtained, so that various operating characteristics (e.g., overload characteristic) of the sensor can be displayed at an alarm display circuit of the receiver.

Figure 2:
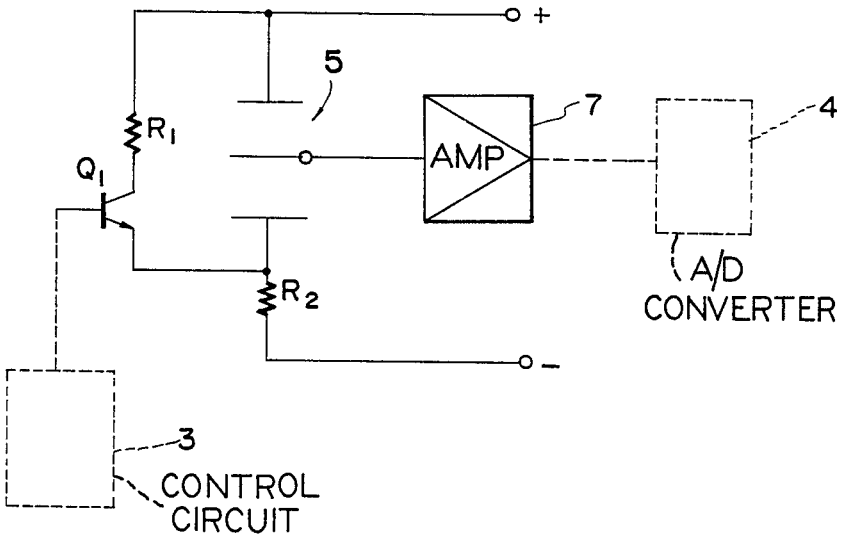
FIG. 2 is a circuit diagram of a test voltage generator forming the test circuit according to a first embodiment of the present invention when an ionization type smoke sensor is used as a sensor.

FIG. 2 is a circuit diagram of a test voltage generator 6 according to a first embodiment of the present invention when an ionization type smoke sensor is used as a sensor 5. The test voltage generator 6 comprises a series circuit of a resistor R1, a transistor Q1, and a resistor R2. The series circuit is connected between positive and negative power source terminals. The positive electrode of the sensor 5 is connected to the positive power source terminal, and the negative electrode thereof is connected to a common node between the emitter of the transistor Q1 and the resistor R2. The intermediate electrode of the sensor is connected to an A/D converter 4 through a high-impedance amplifier 7.

The mode of operation of the test voltage generator will be described hereinafter. When a drive signal is supplied from a control circuit 3 to the base of the transistor Q1, the transistor Q1 is turned on, and a voltage at the common node between the emitter of the transistor Q1 and the resistor R2 (i.e., the voltage at the negative electrode of the sensor 5) is set to be a voltage obtained by dividing the power source voltage by the resistors R1 and R2. Therefore, the voltage at the intermediate electrode of the sensor 5 (i.e., the output voltage from the sensor 5) is increased in accordance with the test voltage. Therefore, the A/D converter 4 generates a digital signal corresponding to the sensor output. In this embodiment, only one resistor R1 and transistor Q1 pair is used. However, a plurality of pairs of resistors R1 and transistors Q1 may used, in which case stepwise components can be obtained.

In the system shown in FIG. 1, the central processor circuit may comprise any one of a number of well-known available microcomputers with appropriate commercially available interface equipment. The control circuit 3 may comprise a digital word storage for the address signal and for the test instruction signal and a digital comparator for comparing received digital words and comparing to the stored digital address and digital test instruction signal word. Activation of the analog-to-digital converter 4 may be provided according to a number of well-known prior art techniques such as supplying operating voltage or triggering thereto. Similarly, the base drive current for transistor Q1 in FIG. 2 may be provided by the control circuit through simple voltage amplifying circuitry triggered by the digital comparator.

Figure 3:
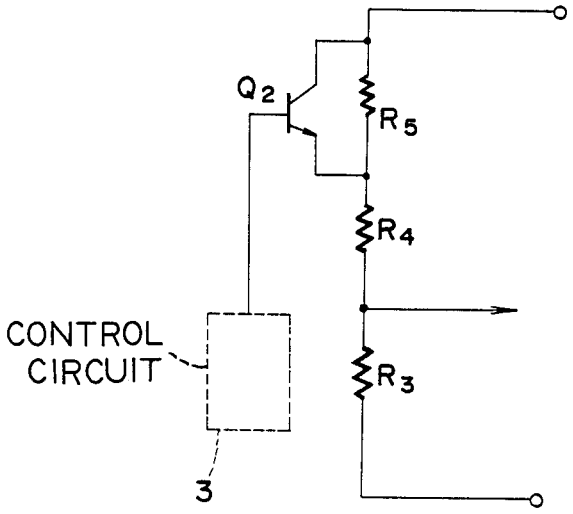
FIG. 3 is a circuit diagram of a test voltage generator forming a test circuit according to a second embodiment of the present invention when a platinum resistor is used as a sensor.

FIG. 3 is a circuit of a test voltage generator according to a second embodiment of the present invention when a platinum resistor R3 is used as a sensor 5.

Referring to FIG. 3, a series circuit of a resistor R5, a reference resistor R4, and the platinum resistor R3 is connected between positive and negative power source terminals. The collector of a transistor Q2 is connected to one end of the resistor R5. The emitter of the transistor Q2 is connected to the other end of the resistor R5. When a drive signal is supplied from a control circuit 3 to the base of the transistor Q2, the transistor Q2 is turned on, thereby short-circuiting the resistor R5. Therefore, a voltage at the common node between the reference resistor R4 and the platinum resistor R3 is increased. The platinum resistor R3 serves as a heat sensor for changing its resistance in accordance with a change in temperature. Therefore, the heat sensor generates an output increased only by the test voltage.

Although various minor changes and modifications might be proposed by those skilled in the art, it will be understood that we wish to include within the claims of the patent warranted hereon all such changes and modifications as reasonably come within our contribution to the art.

We claim as our invention:

1. In an alarm system having a transmission line, a plurality of sensor terminal units each having a sensor connected to one end of the transmission line in a distributed manner and a receiver means connected to the other end of the transmission line for addressing various ones of the plurality of terminal units to receive an alarm signal therefrom and for sending a test instruction signal thereto, wherein the improvement comprises: each terminal unit having a test voltage generator means connected to said sensor for changing an analog output voltage of the sensor by a predetermined amount for testing operation of the terminal unit; and control circuit means responsive to the test instruction signal for activating said test voltage generator means.

2. An improved system according to claim 1 wherein said sensor comprises an ion smoke sensor connected between first and second power source terminals and having an output terminal for output of an analog sensor voltage, and said test voltage generator means comprises a first impedance in series with a control transistor forming a series circuit, a second impedance between one of the power source terminals and the sensor, and said series circuit being connected between the other power source terminal and the junction between the sensor and second impedance.

3. An improved system according to claim 1 wherein said sensor comprises a heat sensing resistance connected between first and second power source terminals to a reference resistance, and said test voltage generator means comprises a parallel circuit of a control transistor and resistance, said parallel circuit lying between one of the power source terminals and heat sensing resistance.

4. An alarm system test circuit responsive to a test instruction signal received from a remote control unit, comprising: control circuit means for recognizing a test instruction signal received from the remote unit; sensor means for detecting smoke, heat, or other alarm inducing parameters and having an analog voltage output indicative of an alarm parameter being sensed; and test voltage generator means activated by the control circuit means and connected to the sensor means for causing a predetermined analog voltage change from the sensor means useful in testing operation of an alarm system associated with the sensor means.

5. A circuit according to claim 4 wherein the analog output of the sensor means is connected to a digital signal.

6. A test circuit of an alarm system formed of a transmission line, a plurality of terminal units connected to one end of said transmission line in a distributed manner, a receiver connected to the other end of said transmission line, each of said plurality of terminal units including a sensor connected to an amplifier, and an A/D converter connected to an interface, said test circuit comprising:

a test voltage generator which has a series circuit of a first resistor, a first transistor, and a second resistor, said series circuit being connected between positive and negative power source terminals;

a control circuit means for activating the test voltage generator;

an analog output generated by said sensor which comprises a test voltage and a normally detected voltage, and which is converted into a digital output by said A/D converter, and a digital output therefrom being supplied to said receiver when said receiver supplies an address signal and a test instruction signal to a corresponding one of said terminal units.

7. A circuit according to claim 6 wherein said test voltage generator generates a voltage having a plurality of stepped voltage components.

8. A circuit according to claim 6 wherein said test voltage generator comprises a third resistor and a second transistor connected in parallel therewith, said third resistor being connected in series with said sensor, said sensor comprising a resistor as a heat sensor having a predetermined temperature coefficient.

* * * * *